US005172966A

United States Patent [19]

Myatt

[11] Patent Number: 5,172,966

[45] Date of Patent: Dec. 22, 1992

[54] PAPER TOWEL AND TOILET PAPER PORTABLE DISPENSER

[76] Inventor: Patricia A. Myatt, 191 Willoughby St., Apt. 4-A, Brooklyn, N.Y. 11201

[21] Appl. No.: 710,747

[22] Filed: May 31, 1991

[51] Int. Cl.[5] ..... B65H 19/00

[52] U.S. Cl. ..... 312/34.8; 225/43

[58] Field of Search ..... 312/38, 39, 40, 41; 225/39, 43, 46

[56] References Cited

U.S. PATENT DOCUMENTS

| | | | |
|---|---|---|---|
| 851,835 | 4/1907 | Ramsey | 225/43 |
| 1,029,490 | 6/1912 | Connor | 312/39 |
| 2,978,156 | 4/1961 | Yaniello | 225/46 |

*Primary Examiner*—Kenneth J. Dorner

*Assistant Examiner*—Gerald A. Anderson

*Attorney, Agent, or Firm*—Richard L. Miller

[57] ABSTRACT

A paper towel and toilet paper portable dispenser is provided and consists of a housing having a cylindrical body, a pair of end walls and a longitudinal flap between the end walls to provide an opening the said housing. A mechanism is for rotatively retaining a roll of paper toweling/toilet tissues within the housing between the pair of end walls so that a free portion of the roll can extend through the opening in the housing. A mechanism is secured along the edge of the opening in the housing, for tearing off the free portion of the roll so that a person utilize the free portion. A strap is affixed to the rotative retaining mechanism for carrying the dispenser.

4 Claims, 1 Drawing Sheet

PAPER TOWEL AND TOILET PAPER PORTABLE DISPENSER

BACKGROUND OF THE INVENTION

The instant invention relates generally to toilet paper and paper towel holders and more specifically it relates to a paper towel and toilet paper portable dispenser.

Numerous toilet paper and paper towel holders have been provided in the prior art that are adapted to be mounted to flat vertical surfaces so that the toilet paper/paper towel can be removed therefrom. For example, U.S. Pat. Nos. Des. 201,298 to Bahnsen; Des. 216,740 to Bye; Des. 223,049 to Brooks; Des. 235,932 to Douglas; and Des. 247,465 to Ford all are illustrative of such prior art. While these units may be suitable for the particular purpose to which they address, they would not be as suitable for the purpose of the present invention as hereafter described.

SUMMARY OF THE INVENTION

A primary object of the present invention is to provide a paper towel and toilet paper portable dispenser that will overcome the shortcomings of the prior art devices.

Another object is to provide a paper towel and toilet paper portable dispenser that is a protective cover to prevent the paper towel and toilet paper rolls from becoming dirty, while at the same time providing a traveller with a convenient mechanism for carrying a personal roll of paper towel and/or toilet paper.

An additional object is to provide a paper towel and toilet paper portable dispenser that will fit securely around the roll, held tightly by VELCRO ® strips and be carried by a strap.

A further object is to provide a paper towel and toilet paper portable dispenser that is simple and easy to use.

A still further object is to provide a paper towel and toilet paper portable dispenser that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
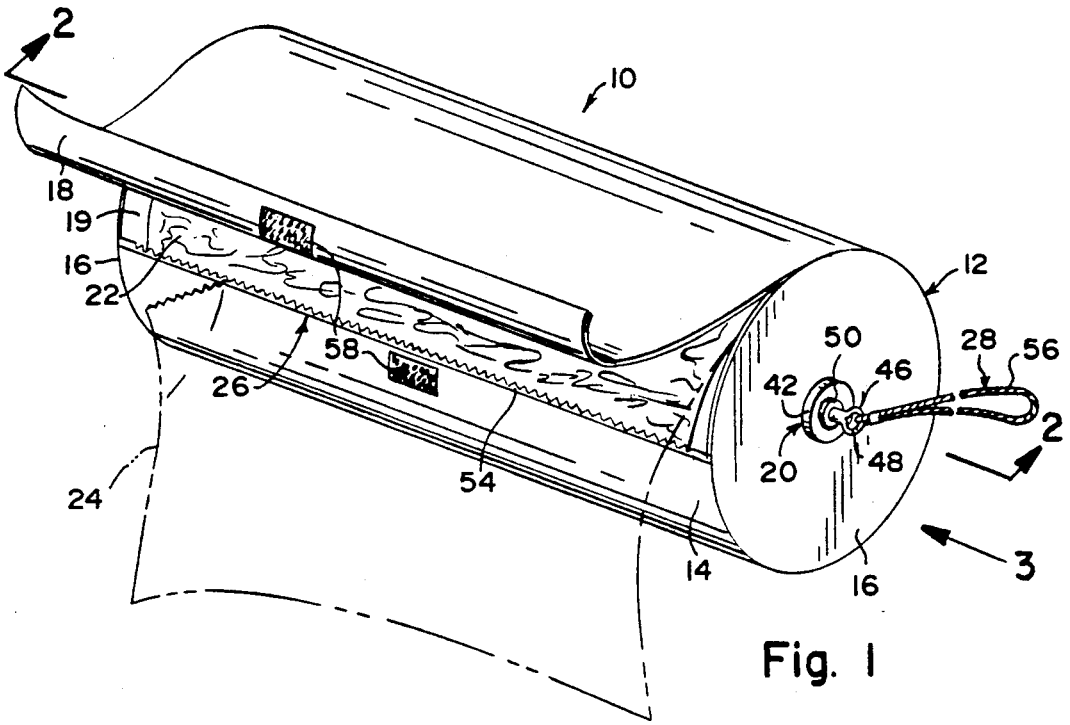
FIG. 1 is a perspective view of the instant invention with the flap open and illustrating paper being torn off in phantom.
Figure 2:
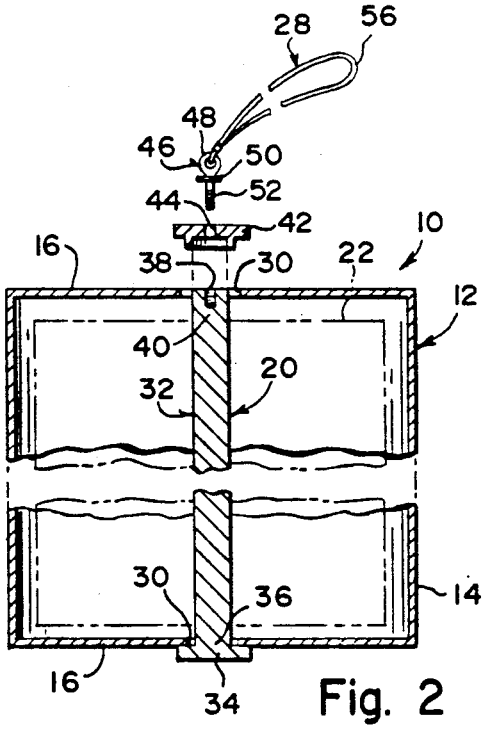
FIG. 2 is an enlarged cross sectional view with parts broken away taken on line 2—2 of FIG. 1.
Figure 3:
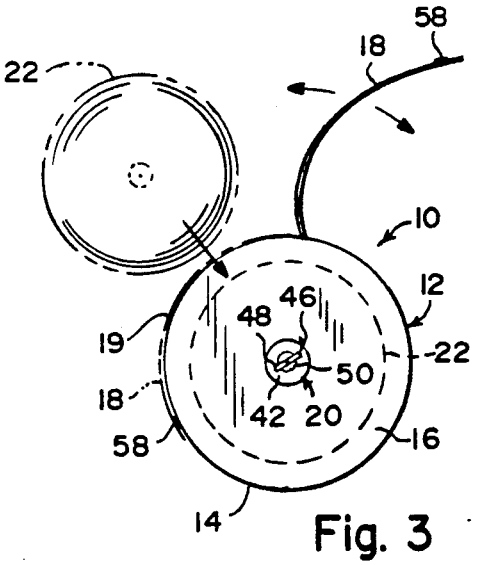
FIG. 3 is an end view taken in the direction of arrow 3 in FIG. 1.

Turning now descriptively to the drawings, in which similar reference characters denote similar elements throughout the several views, the Figures illustrate a paper towel and toilet paper portable dispenser 10 which consists of a housing 12 having a cylindrical body 14, a pair of end walls 16 and a longitudinal flap 18 between the end walls 16 to provide and opening 19 in the cylindrical body 14 of the housing 12. A mechanism 20 is for rotatively retaining a roll 22 of paper toweling-/toilet tissues within the cylindrical body 14 of the housing 12 between the pair of end walls 16 so that a free portion 24 of the roll 22 can extend through the opening 19 in the cylindrical body 14 of the housing 12. A mechanism 26 is along the edge of the opening 19 in the cylindrical body 14 of the housing, for tearing off the free portion 24 of the roll 22 so that a person can utilize the free portion 24. A mechanism 28 is affixed to the rotatively retaining mechanism 20, for carrying the dispenser 10.

The rotatively retaining mechanism 20 includes the end walls 16 of the housing 12 having aligned apertures 30 therethrough. An elongated rod 32 has an enlarged head 34 on a first end 36 and a threaded bore 38 in a second end 40. The rod 32 extends through the aligned aperture 30 to carry the roll 22 with the enlarged head 34 bearing against one of the end walls 16. An end cap 42 has a hole 44 therethrough and is sized to fit into one of the apertures 30 and onto the second end 40 of the rod 32. An eye bolt 46 has a looped head 48, a collar 50 and a threaded shank 52 to pass through the hole 44 in the end cap 42 to be engagable with the threaded bore 38 in the second end 40 of the rod 32.

The tearing mechanism 26 is a serrated cutting blade 54. The carrying mechanism 28 is a strap 56 extending through the looped head 48 of the eye bolt 46 so that a person can grip the strap 56 and carry the dispenser 10 therefrom. The dispenser 10 further includes hook and loop fabric fastener tabs 58 on the flap 18 and the cylindrical body 14 so as to releasably hold the flap 18 to the cylindrical body 14 of the housing 62.

To use the dispenser 10, a person simply opens the flap 18 pulls out a free portion 24 of the roll 22 and tears it along the serrated cutting blade 54. The flap 18 can be reclosed with the interlocking hook and loop fabric fastener tabs 58 and then carried by the strap 56.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A paper towel and toilet paper portable dispenser which comprises:

a) a housing having a cylindrical body, a pair of end walls and a longitudinal flap between the end walls to provide an opening in the cylindrical body of said housing;

b) means for rotatively retaining a roll of paper toweling/toilet tissues within the cylindrical body of said housing between the pair of end walls so that a free portion of the roll can extend through the opening in the cylindrical body of said housing, wherein said rotative retaining means includes;

i) the end walls of said housing having aligned apertures therethrough;

ii) an elongated rod having an enlarged head on a first end and a threaded bore in a second end, said rod extendable through one of the aligned apertures with the enlarged head bearing against one of the end walls;

iii) an end cap having a hole therethrough and sized to fit into one of the apertures an onto the second end of the said rod; and iv) an eye bolt having a looped head, a collar and a threaded shank to pass through the hole in said end cap to engage the threaded bore in the second end of said rod;

c) means along an edge of the opening in the cylindrical body of said housing for tearing off the free portion of the roll so that a person can utilize the free portion; and d) means affixed to said rotative retaining means for carrying said dispenser.

2. A paper towel and toilet paper portable dispenser as recited in claim 1, wherein said tearing means is a serrated cutting blade.

3. A paper towel and toilet paper portable dispenser as recited in claim 2, wherein said carrying means is a strap extending through the looped head of said eye bolt so that a person can grip said strap and carry said dispenser therefrom.

4. A paper towel and toilet paper portable dispenser as recited in claim 3, further including hook and loop fabric fastener tabs on the flap and the cylindrical body so as to releasably hold the flap to the cylindrical body of said housing.

* * * * *